US006559811B1

(12) United States Patent
Pulimi et al.

(10) Patent No.: US 6,559,811 B1
(45) Date of Patent: May 6, 2003

(54) ANTENNA WITH BRANCHING ARRANGEMENT FOR MULTIPLE FREQUENCY BANDS

(75) Inventors: Narendra Pulimi, Rolling Meadows, IL (US); Christopher P. Cash, Woodstock, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/054,380

(22) Filed: Jan. 22, 2002

(51) Int. Cl.[7] ..... H01Q 1/36
(52) U.S. Cl. ..... 343/895; 343/702; 343/900
(58) Field of Search ..... 343/702, 790, 343/895, 893, 900

(56) References Cited

U.S. PATENT DOCUMENTS

| | | | | |
|---|---|---|---|---|
| 4,442,438 A | | 4/1984 | Siwiak et al. | |
| 5,600,341 A | | 2/1997 | Thill et al. | |
| 5,812,097 A | * | 9/1998 | Maldonado | 343/790 |
| 5,990,848 A | | 11/1999 | Annamaa et al. | |
| 6,054,966 A | | 4/2000 | Haapala | |
| 6,127,979 A | | 10/2000 | Zhou et al. | |
| 6,140,973 A | * | 10/2000 | Annamaa et al. | 343/790 |
| 6,198,440 B1 | * | 3/2001 | Ha et al. | 343/702 |
| 6,201,500 B1 | * | 3/2001 | Fujikawa | 343/702 |
| 6,288,681 B1 | * | 9/2001 | Kim et al. | 343/702 |
| 6,348,900 B1 | * | 2/2002 | Blom | 343/895 |
| 6,448,934 B1 | * | 9/2002 | Lee et al. | 343/702 |
| 2002/0097192 A1 | * | 7/2002 | Chang et al. | 343/895 |

* cited by examiner

*Primary Examiner*—Don Wong
*Assistant Examiner*—Shih-Chao Chen
(74) *Attorney, Agent, or Firm*—Brian M. Mancini

(57) ABSTRACT

A communication device operable in multiple frequency bands includes a branching antenna adapted to operate in at least two frequency bands. The antenna includes a first conductive element having a connection at one end for driving the antenna. The first conductive element is resonant at a first frequency. On the first conductive element, a feed point is located away from either end of the first conductive element, and particularly the driving connection point. A second conductive element is coupled to the feed point such that the second conductive element in conjunction with the portion of the first conductive element between the drive connection and the feed point is resonant at a second frequency. This allows for a more compact and versatile multi-band antenna.

20 Claims, 6 Drawing Sheets

ANTENNA WITH BRANCHING ARRANGEMENT FOR MULTIPLE FREQUENCY BANDS

FIELD OF THE INVENTION

The present invention is related to an antenna, and more particularly to an antenna adapted to operate in more than one frequency band.

BACKGROUND OF THE INVENTION

With the increased use of wireless communication devices, available spectrum to carry communication signals is becoming limited. In many cases, network operators providing services on one particular band have had to provide service on a separate band to accommodate its customers. For example, network operators providing service on the Global System of Mobile (GSM) communication system in a 900 MHz frequency band have had to also rely on operating on the Digital Communication System (DCS) at an 1800 MHz frequency band. Accordingly, wireless communication devices, such as cellular radiotelephones, must be able to communicate at both frequencies, or possibly a third frequency spectrum, such as the Personal Communication System (PCS) 1900 MHz.

Such a requirement to operate at two or more frequencies creates a number of problems. For example, the wireless communication device must have an antenna adapted to receive signals on more than one frequency band. Also, as wireless communication devices decrease in size, there is a further need to reduce the size of an antenna associated with the device.

Further, while an extendible antenna offers certain advantages, such an antenna poses problems to an end user. Because the antenna will typically perform better when in the extended position, the user is required to extend the antenna before operating the wireless communication device. Users may not regularly do this as the device may usually operate with the antenna in a retracted position, and this action requires extra effort. As a result, many end users prefer a fixed or "stubby" antenna which does not need to be extended during operation. However, the fixed antenna must provide multi-band functionality.

Prior art approaches to provide multiple band operation include separate antenna elements fed from a common or multiple feed points configured in a co-located arrangement. These elements are individual resonators that do not shared components and therefore take up more room than necessary.

Accordingly, there is a need for a small fixed antenna adapted to receive signals in multiple frequency bands. In addition, it would be of benefit if the different resonant elements of the antenna shared at least of portion of the other resonant elements. It would also be advantageous to provide the antenna structure in a compact, fixed structure.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENTS

The present invention provides a small fixed antenna adapted to receive signals in multiple frequency bands. Instead of separate resonant elements, the present invention provides a branching tree structure for the antenna wherein elements can share components of other element in order to provide the necessary multiple frequency resonances. This is achieved in a low-cost structure without any degradation in performance over prior art antennas. The present invention also has the benefit of providing an antenna in a compact, fixed structure.

The present disclosure is related to an antenna adapted to receive signals in multiple frequency bands. In particular, the antenna takes on a tree-like structure with a base element or trunk and several branches extending therefrom. The base element combined with the individual branches provide the necessary independent frequencies. Moreover, the branches can have further branches to provide additional resonances. Specifically, the antenna preferably comprises a fixed antenna elements that can include a whip or straight wire portion or a helical coil antenna element coupled to a single feed point. Preferably, a single matching circuit is adapted to provide matching for both the whip antenna and the helical coil antenna, while also providing static protection. A dielectric material preferably surrounds the whip portion and provides support for the helical coil antenna. A single connection is used to couple the antenna to the wireless communication device although multiple connections can be used.

Figure 1:
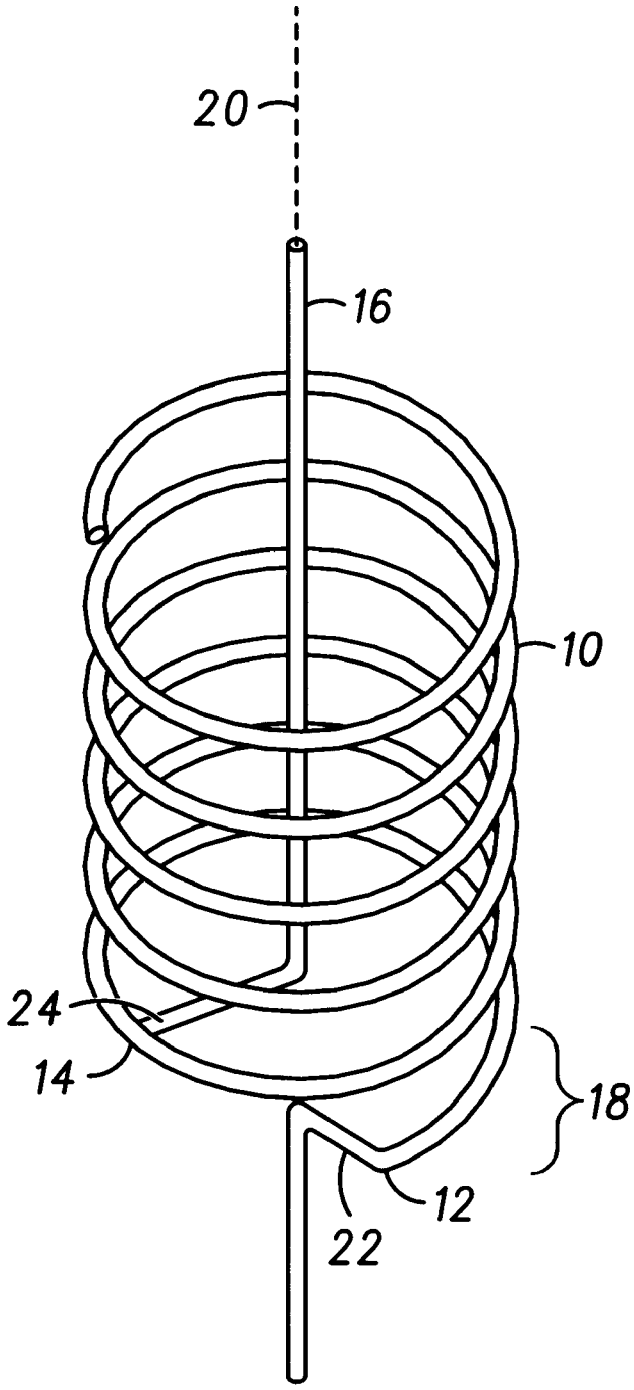
FIG. 1 is an isometric view of a two-branch antenna embodiment, in according with the present invention.

Turning first to FIG. 1, a first embodiment of an antenna is shown. In its simplest form, the present invention provides an antenna adapted to operate in at least two frequency bands. This requires a two-branch tree structure that includes a first conductive element 10 having a drive connection 12 at one end thereof for driving the antenna. The first conductive element 10 is resonant at a first frequency. A first feed point 14 is located on the first conductive element 10. However, the first feed point 14 is not co-located with the drive connection 12. Instead, the first feed point 14 is located away from either end of the first conductive element 10. The first feed connection 14 can be located anywhere along the length of the first conductive element 10 except at the drive connection 12. A second conductive element 16 is coupled to the first feed point 14. The second conductive element 16 in conjunction with the portion 18 of the first conductive element 10 between the drive connection 12 and the first feed point 14 is resonant at a second frequency. Typically, the first and second frequencies are different having substantially non-overlapping bands. However, the first and second frequencies can be the same or close to each other to provide a wider bandwidth than is available with a single antenna element.

Although FIG. 1 shows the first conductive element as having a helical configuration and the second conductive element as having a straight wire configuration, the present invention encompasses an antenna wherein the conductive elements are each selected from one of the group consisting of a substantially helical configuration and a substantially straight wire configuration. In other words, the first and second conductive elements can both be of a straight wire configuration, the first and second conductive elements can both be of a substantially helical configuration, the first conductive element can be a helix while the second conductive element is a straight wire, or the first conductive element can be a straight wire while the second conductive element is a helix. Preferably, the latter arrangement is used, as represented in FIG. 1. More particularly, one of the conductive elements, such as the first element for example, has a substantially helical configuration with a central axis 20, and the other of the conductive elements, such as the second element for example, is a substantially straight wire configuration being aligned parallel to the central axis 20 of the helical configuration. This configuration reduces the capacitive coupling between the elements. More preferably, the drive connection and antenna elements are located coaxially, and the lateral connections 22,24 for the elements are located orthogonally to each other to reduce cross coupling, as shown in FIG. 1.

Figure 2:
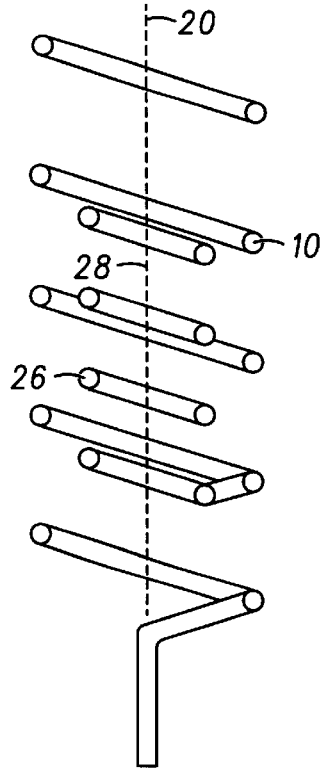
FIG. 2 is a partial cross-sectional view of an alternate two-branch antenna embodiment, in according with the present invention.
Figure 3:
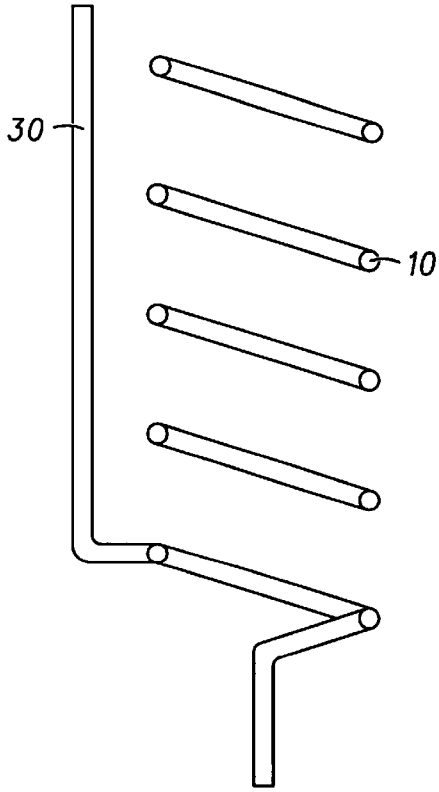
FIG. 3 is a partial cross-sectional view of an another alternate two-branch antenna embodiment, in according with the present invention.

There are also the practical aspects for choosing particular element configurations. For example, there are particular configuration considerations when one element operates at about twice the frequency of the other element. In this case, a helix operating at about half the frequency of a straight wire will have about the same height as the straight wire. This results in a more compact antenna structure. In contrast, if two straight wires or two helices are used, one element would be about twice the length of the other element, taking up more volume and defeating the desire for the least obtrusive antenna structure size. However, it is possible to have alternate embodiments such as the case wherein a portion of the second conductive element 26 has a substantially helical configuration with a central axis 28 located coaxially with a central axis 20 of the helical configuration of the first conductive element 10, as shown in FIG. 2, or wherein a portion of the second conductive element 30 is a straight wire located parallel to, but not coaxial (not within) the helix of the first element 10, as shown in FIG. 3.

Figure 4:
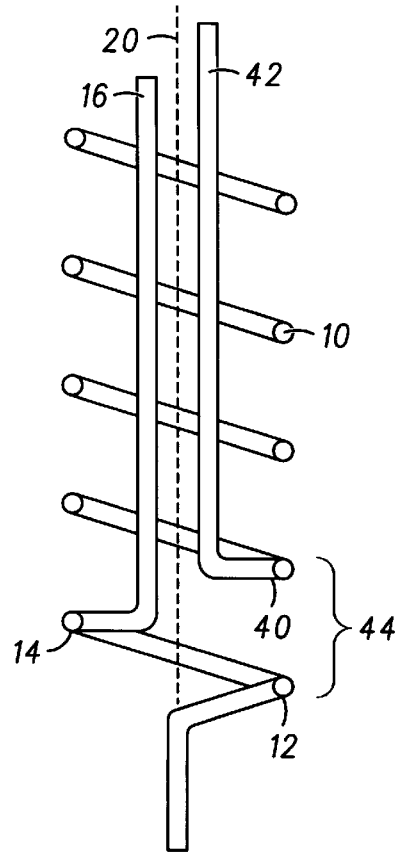
FIG. 4 is a partial cross-sectional view of a first three-branch antenna embodiment, in according with the present invention.
Figure 5:
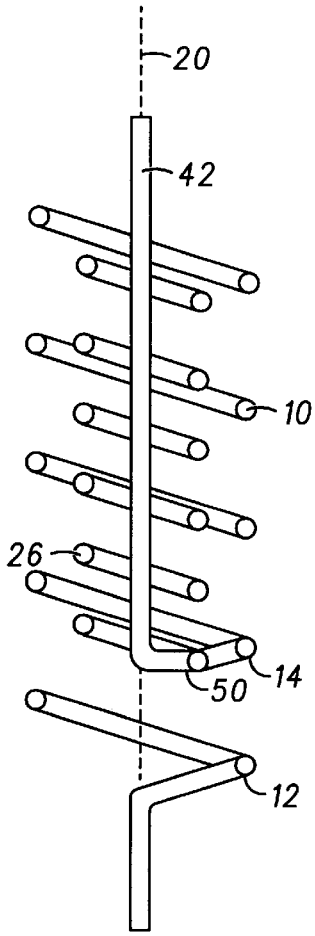
FIG. 5 is a partial cross-sectional view of an alternate first three-branch antenna embodiment, in according with the present invention.
Figure 6:
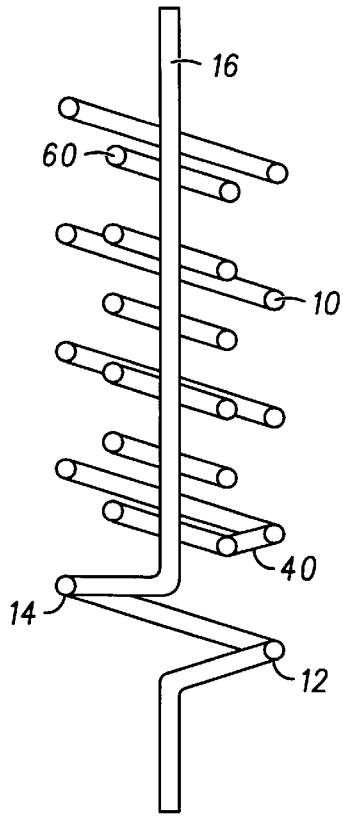
FIG. 6 is a partial cross-sectional view of another alternate first three-branch antenna embodiment, in according with the present invention.

Turning now to FIG. 4, a partial cross-sectional view shows an antenna identical to that of FIG. 1 with the addition of a third branch to the tree-like antenna structure. In particular, FIG. 4 shows the addition of a second feed point 40 located on the first conductive element 10. The second feed point 40 is located away from either end of the first conductive element 10. The second feed point 40 can be located anywhere along the first conductive element 10 except at those points. The second feed point 40 can be located away from the first feed point 12, or it can be co-located with the first feed point 12, shown as 50 in FIG. 5. A third conductive element 42 is coupled to the second feed point 40. The third conductive element 42, in conjunction with the portion 44 of the first conductive element 10 between the drive connection 12 and the second feed point 40, is resonant at a third frequency. As in the previous case, each of the elements can be either of a substantially helical configuration and a substantially straight wire configuration. As a result, FIGS. 4 (and 5) can be embodied in as much as eight different configurations. Due to size configurations, it is desired that the first element 10 be a helix and a portion of the second conductive element 16 and a portion of the third conductive element 42 are each of a substantially straight wire configuration being aligned parallel to a central axis 20 of the helical configuration of the first conductive element 10. However, other configurations can be used. For example, the first element 10 and third element 60 can be helices with the second element 16 being a straight wire, as shown in FIG. 6.

Figure 7:
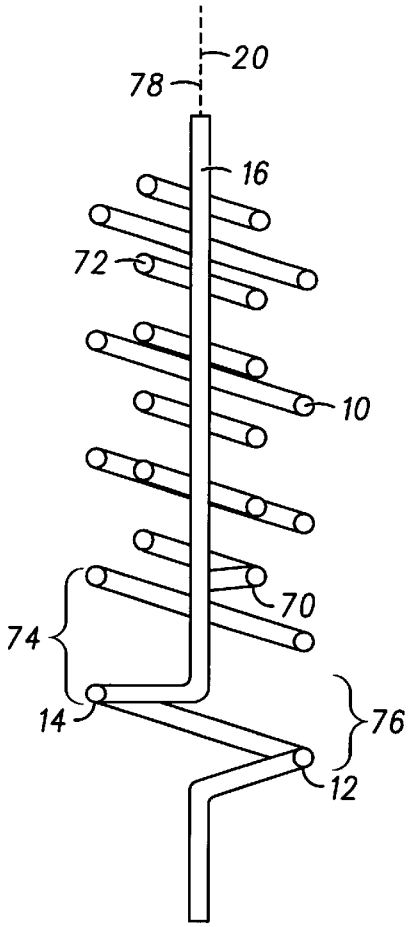
FIG. 7 is a partial cross-sectional view of a second three-branch antenna embodiment, in according with the present invention.
Figure 8:
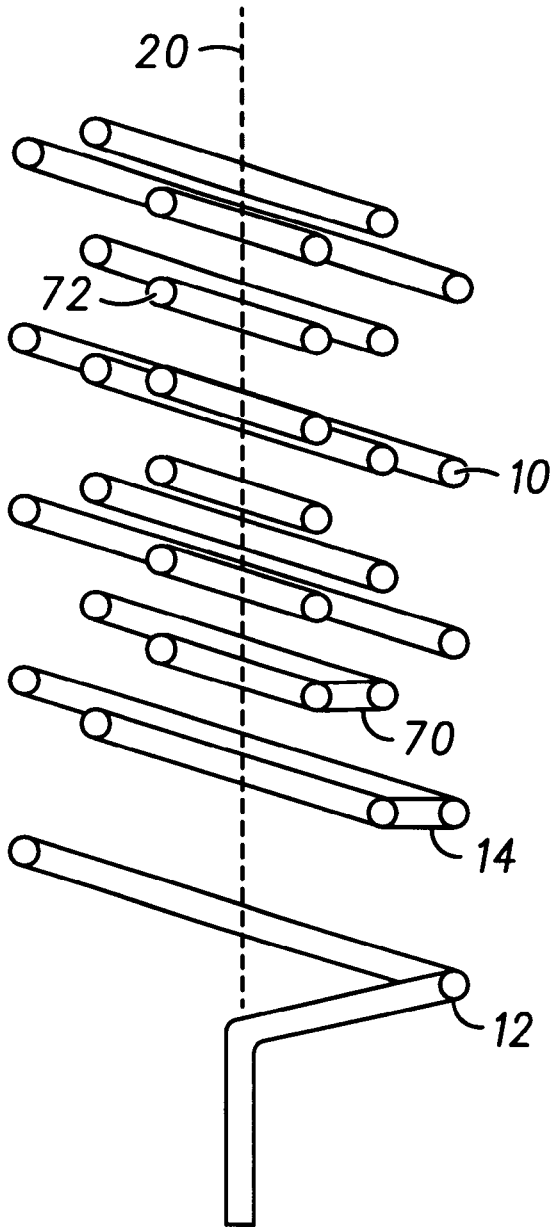
FIG. 8 is a partial cross-sectional view of an alternate second three-branch antenna embodiment, in according with the present invention.

FIG. 7 shows an alternative three-branch antenna structure in accordance with the present invention. In particular, FIG. 7 shows the addition of a second feed point 70 located on the second conductive element 16 instead of the first conductive element 10. The second feed point 70 can be located at or away from the first feed point. Preferably, the second feed point 70 is located away from the first feed point 14. More preferably, the second feed point 70 can be located anywhere along the second conductive element 16 except at that point 14. A third conductive element 72 is coupled to the second feed point 70. The third conductive element 72 in conjunction with the portion 74 of the second conductive element 16 between the first and second feed points 14,70 and the portion 76 of the first conductive element 10 between the drive connection 12 and the first feed point 14 is resonant at a third frequency. As in the previous case, each of the elements can be either of a substantially helical configuration and a substantially straight wire configuration. As a result, FIG. 7 can be embodied in as much as eight different configurations. However, due to size configurations, it is desired that the first element 10 be a helix and the second and third elements 16,72 be straight wires (not shown). More particularly, the first conductive element 10 has a substantially helical configuration with a central axis 20. A major portion (i.e. those parts that are parallel to the central axis 20) of each of the second and third conductive elements 16,72 are each selected from one of the group consisting of a substantially straight wire configuration (16 for example) being aligned parallel to the central axis 20 of the helical configuration of the first conductive element 10 and a substantially helical configuration (72 for example) with a central axis 78 located coaxially with the central axis 20 of the helical configuration of the first conductive element 10. However, it should be recognized that other configurations can be made, such as the three helix embodiment of FIG. 8.

In all of the above cases, there is the practical consideration of connecting each element with each feed point while maintaining the symmetry of the element. For example, lateral connections (such as 22,24 in FIG. 1) are used for these connections to extend the elements away from each other. However, in all cases, a major portion (i.e. those parts that are parallel to the central axis 20) of each of the conductive elements are each selected from one of the group consisting of a substantially straight wire configuration and a substantially helical configuration.

In practice, the antenna is coupled and matched to the circuitry of a communication device as is known in the art. However, there are various other practical considerations to be made, as are known in the art. For example, the length of the monopole generally effects vertical polarization, where a longer monopole generally provides greater vertical polarization. The length and axial and radial dimensions of the conductive elements are preferably selected to optimize the efficiency of the antenna. That is, the size, length, width and diameter of the elements are selected to provide the proper inductance or capacitance for the antenna, as are known in the art. For example, a narrower element provides greater inductance and wider element provides greater capacitance. In addition, longer elements have lower frequencies.

The antenna structure can also include a protective support and covering as is known in the art. For example, helical elements can be wound on a dielectric core within an overmold (not shown), which also preferably comprises a dielectric material. For example, the core could be a dielectric material comprising santoprene and polypropylene. For example, the dielectric core could be composed of 75% santoprene and 25% polypropylene to create dielectric material having a dielectric constant of 2.0. Within the dielectric core a dielectric sleeve can be used to cover elements with straight wire portions. For example, the dielectric sleeve could be a Teflon™ material. In addition to providing a wider bandwidth, the dielectrics provide mechanical strength to the antenna. As long as proper dielectric constants can be found solid plastic could also be used. Alternatively, some areas of the antenna could remain empty, whereby air which has a dielectric constant of one, which also provides good electrical characteristics. Further, helical elements could also be completely surrounded by a dielectric.

In order to transmit and receive signals in the DCS band (1710–1880 MHz frequencies) and the PCS band (1850–1990 MHz frequencies), wire of a 0.5 mm width is used. In order to transmit and receive signals in the GSM band (880–960 MHz frequencies), the helical coil element is selected to be a length of approximately 21 mm with a pitch dimension of approximately 3.5 mm and a radius of 3 mm. The helical element is coupled to a 2 mm long base and 4 mm length of coaxial cable. A straight wire element is selected to be a length of approximately 25 mm, coupled 2 mm above the base of the helical element. Of course, other dimensions for the frequency bands mentioned or other frequency bands could be used according to the present invention. It is also envisioned that antenna embodiments of the present could be coupled in an extendable antenna configuration. In particular, the present invention can be coupled at an end of an extendable antenna. It is also envisioned, the first, second (and third) resonant elements of the various embodiments of the antenna of the present invention, can be configured to operate at the same of nearly the same frequencies in order to proved widened bandwidth operation at a particular frequency band. In other words, the first, second (and third) operating frequencies are the same or nearly the same.

Figure 9:
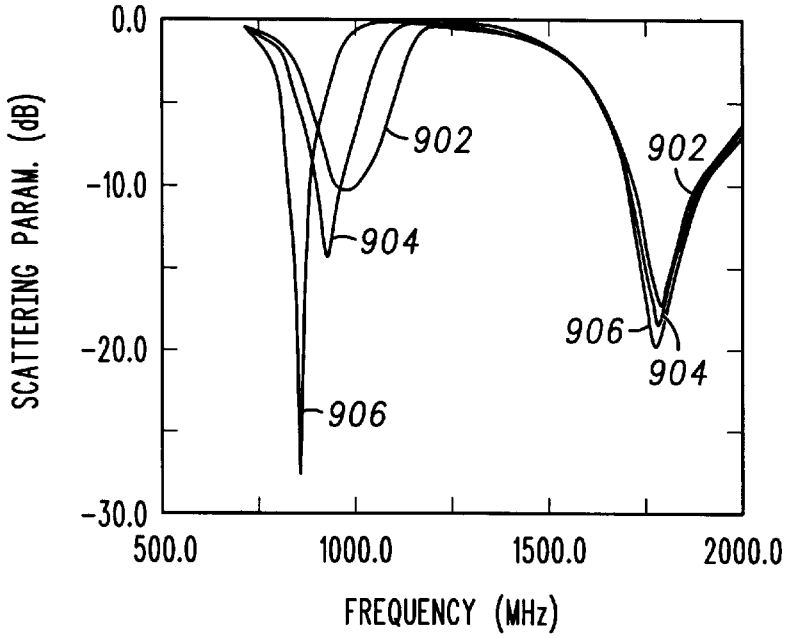
FIG. 9 is a graphical representation demonstrating operation of the antenna of FIG. 1, with changes in helical length.
Figure 10:
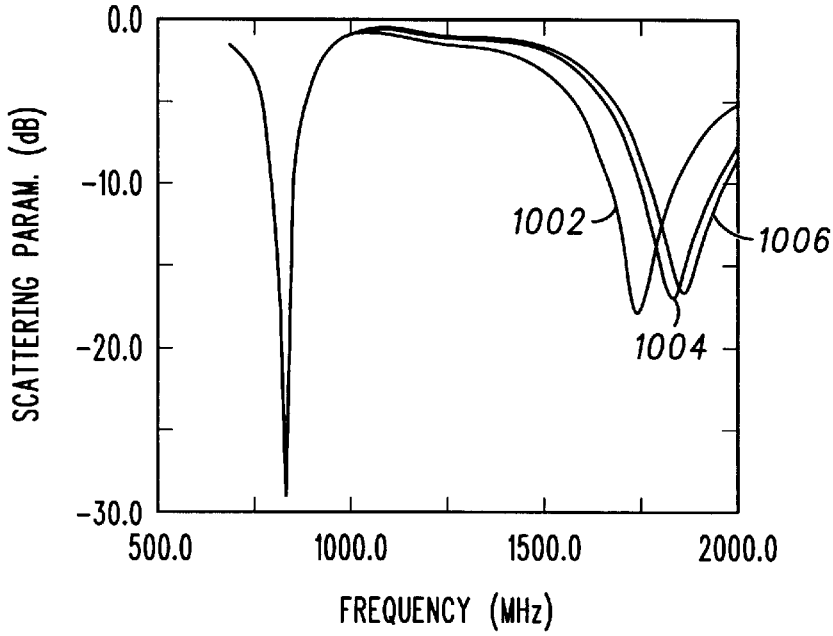
FIG. 10 is a graphical representation demonstrating operation of the antenna of FIG. 1, with changes in straight wire length.

Turning now to FIG. 9, a graph shows the return loss in 5 dB increments as a function of frequency according to the antenna of FIG. 1 of the present invention, utilizing a first helical element and second straight wire elements. As can be seen in the figure, the antenna will operate at a dual resonance for signals between 830–960 MHz band and 1710–2000 MHz band, which covers the frequency bands of AMPS, GSM, DCS, PCS, and PHS. With modifying the length of the straight wire and the helical coil, the resonating frequency can be tuned to any frequency band desired. Several studies were conducted to change the configuration of one element to see the affect on its resonance as well as the effect on the other resonance. In particular, the lengths of each element were varied. In FIG. 9, the length of the helical element was varied from 17 mm to 19 mm to 22 mm. In particular, curve 902 shows the response with a 17 mm length, curve 904 shows the response with a 19 mm length, and curve 906 shows the response with a 22 mm length. As can be seen, the lower resonance changes with the length of the helix. Surprisingly, the upper resonance, which includes the resonance of the straight wire along with part of the changing length of the helix between the drive connection and the straight wire feed connection, does not shift frequency significantly. FIG. 10 shows the changes when the length of the straight wire is varied from 27 mm to 24 mm to 22 mm. In particular, curve 1002 shows the response with a 27 mm length, curve 1004 shows the response with a 24 mm length, and curve 1006 shows the response with a 22 mm length. In this case, the resonance of the helix at the lower band, which is not part of the straight wire branch, does not shift frequency at all, as expected. Several of the other possible antenna embodiments were also tested with similar results.

In summary, the present disclosure is related to an antenna adapted to receive signals in multiple frequency bands. In particular, the antenna preferably comprises a straight wire element and a helical coil element coupled to different feed point in a branch-like manner.

Although the invention has been described and illustrated in the above description and drawings, it is understood that this description is by way of example only and that numerous changes and modifications can me made by those skilled in the art without departing from the broad scope of the invention. Although the present invention finds particular use in portable cellular radiotelephones, the invention could be applied to any two-way wireless communication device, including pagers, electronic organizers, and computers. Applicants' invention should be limited only by the following claims.

What is claimed is:

1. An antenna adapted to operate in multiple frequency bands, the antenna comprising:

a first conductive element having a connection at one end thereof for driving the antenna, the first conductive element being resonant at a first frequency;

a first feed point located on the first conductive element, the first feed point being located away from either end of the first conductive element; and a second conductive element being coupled to the first feed point wherein the second conductive element in conjunction with the portion of the first conductive element between the connection and the first feed point is resonant at a second frequency.

2. The antenna of claim 1, wherein the conductive elements are each selected from one of the group consisting of a substantially helical configuration and a substantially straight wire configuration.

3. The antenna of claim 2, wherein one of the conductive elements has a substantially helical configuration with a central axis; and the other of the conductive elements is a substantially straight wire configuration being aligned parallel to the central axis of the helical configuration.

4. The antenna of claim 1, further comprising:

a second feed point located on the first conductive element, the second feed point being located away from either end of the first conductive element; and a third conductive element being coupled to the second feed point, wherein the third conductive element in conjunction with the portion of the first conductive element between the connection and the second feed point is resonant at a third frequency.

5. The antenna of claim 4, wherein the conductive elements are each selected from one of the group consisting of a substantially helical configuration and a substantially straight wire configuration.

6. The antenna of claim 1, further comprising:

a second feed point located on the second conductive element; and a third conductive element being coupled to the second feed point, wherein the third conductive element in conjunction with the portion of the second conductive element between the first and second feed points and the portion of the first conductive element between the connection and the first feed point is resonant at a third frequency.

7. The antenna of claim 6, wherein a major portion of each of the conductive elements are each selected from one of the group consisting of a substantially straight wire configuration and a substantially helical configuration.

8. The antenna of claim 6, wherein the first conductive element has a substantially helical configuration with a central axis, and wherein a major portion of each of the second and third conductive elements are each selected from one of the group consisting of a substantially straight wire configuration being aligned parallel to the central axis of the helical configuration of the first conductive element and a substantially helical configuration with a central axis located coaxially with the central axis of the helical configuration of the first conductive element.

9. An antenna adapted to operate in multiple frequency bands, the antenna comprising:

a first conductive element having a substantially helical configuration and a connection at one end thereof for driving the antenna, the first conductive element being resonant at a first frequency;

a first feed point located on the first conductive element, the first feed point being located away from either end of the first conductive element; and a second conductive element being coupled to the first feed point wherein the second conductive element in conjunction with the portion of the first conductive element between the connection and the first feed point is resonant at a second frequency.

10. The antenna of claim 9, wherein a portion of the second conductive element has a substantially helical configuration with a central axis located coaxially with a central axis of the helical configuration of the first conductive element.

11. The antenna of claim 9, wherein a portion of the second conductive element is a substantially straight wire configuration aligned parallel to a central axis of the helical configuration of the first conductive element.

12. The antenna of claim 11, wherein the portion of the second conductive element is aligned along the central axis of the helical configuration of the first conductive element.

13. The antenna of claim 9, further comprising:

a second feed point located on the first conductive element; and a third conductive element being coupled to the second feed point, wherein the third conductive element in conjunction with the portion of the first conductive element between the connection and the second feed point is resonant at a third frequency.

14. The antenna of claim 13, wherein a portion of the second conductive element and a portion of the third conductive element are each of a substantially straight wire configuration being aligned parallel to a central axis of the helical configuration of the first conductive element.

15. The antenna of claim 13, wherein a portion of the second conductive element is of a substantially straight wire configuration being aligned parallel to a central axis of the helical configuration of the first conductive element, and a portion of the third conductive element has a substantially helical configuration with a central axis located coaxially with a central axis of the helical configuration of the first conductive element.

16. The antenna of claim 9, further comprising:

a second feed point located on the second conductive element, the second feed point being located away from the first feed point; and a third conductive element being coupled to the second feed point, wherein the third conductive element in conjunction with the portion of the second conductive element between the first and second feed points and the portion of the first conductive element between the connection and the first feed point is resonant at a third frequency.

17. The antenna of claim 16, wherein a portion of the second conductive element and a portion of the third conductive element are each selected from one of the group consisting of a substantially straight wire configuration being aligned parallel to a central axis of the helical configuration of the first conductive element and a substantially helical configuration with a central axis located coaxially with a central axis of the helical configuration of the first conductive element.

18. A communication device operable in multiple frequency bands includes an antenna comprising:

a first conductive element having a connection at one end thereof for driving the antenna, the first conductive element being resonant at a first frequency;

a first feed point located on the first conductive element, the first feed point being located away from either end of the first conductive element; and a second conductive element being coupled to the first feed point wherein the second conductive element in conjunction with the portion of the first conductive element between the connection and the first feed point is resonant at a second frequency.

19. The communication device of claim 18, wherein the conductive elements are each selected from one of the group consisting of a substantially helical configuration and a substantially straight wire configuration.

20. The communication device of claim 19, wherein one of the conductive elements has a substantially helical configuration with a central axis, and the other of the conductive elements is a substantially straight wire configuration being aligned parallel to the central axis of the helical configuration.

* * * * *